US007310035B2

(12) United States Patent
Wooten

(10) Patent No.: US 7,310,035 B2
(45) Date of Patent: Dec. 18, 2007

(54) MAGNETIC METAL ACCESSORY HOLDER

(76) Inventor: Bret Wooten, 1406 Summer Time Trai, Lewisville, TX (US) 75067

( * ) Notice: Subject to any disclaimer, the term of this patent is extended or adjusted under 35 U.S.C. 154(b) by 0 days.

(21) Appl. No.: 11/155,223

(22) Filed: Jun. 17, 2005

(65) Prior Publication Data

US 2006/0038647 A1 Feb. 23, 2006

Related U.S. Application Data

(60) Provisional application No. 60/602,677, filed on Aug. 17, 2004.

(51) Int. Cl.
*H01F 7/02* (2006.01)

(52) U.S. Cl. ..... 335/306; 335/285; 335/302

(58) Field of Classification Search ..... 335/285, 335/302–306

See application file for complete search history.

(56) References Cited

U.S. PATENT DOCUMENTS

| | | | | |
|---|---|---|---|---|
| 2,176,052 | A * | 10/1939 | Beyer | 132/331 |
| 4,826,059 | A | 5/1989 | Bosch et al. | |
| 5,196,818 | A | 3/1993 | Anderson | |
| 5,333,767 | A * | 8/1994 | Anderson | 224/183 |
| 6,496,094 | B2 * | 12/2002 | May, III | 335/285 |
| 6,643,845 | B2 * | 11/2003 | O'Dea et al. | 2/161.6 |
| 2003/0052143 | A1 | 3/2003 | Devine | |
| 2003/0230606 | A1 | 12/2003 | Devinie | |

* cited by examiner

*Primary Examiner*—Elvin Enad
*Assistant Examiner*—Bernard Rojas
(74) *Attorney, Agent, or Firm*—James Ray & Assoc.

(57) ABSTRACT

A magnetic apparatus, which can be engaged to various preselected objects, is used for holding various articles which are attracted to a magnet. The magnetic apparatus comprises a platform member having a predetermined shape and a predetermined size. At least one magnet is secured to the platform member for holding such articles.

24 Claims, 3 Drawing Sheets

FIG. 5
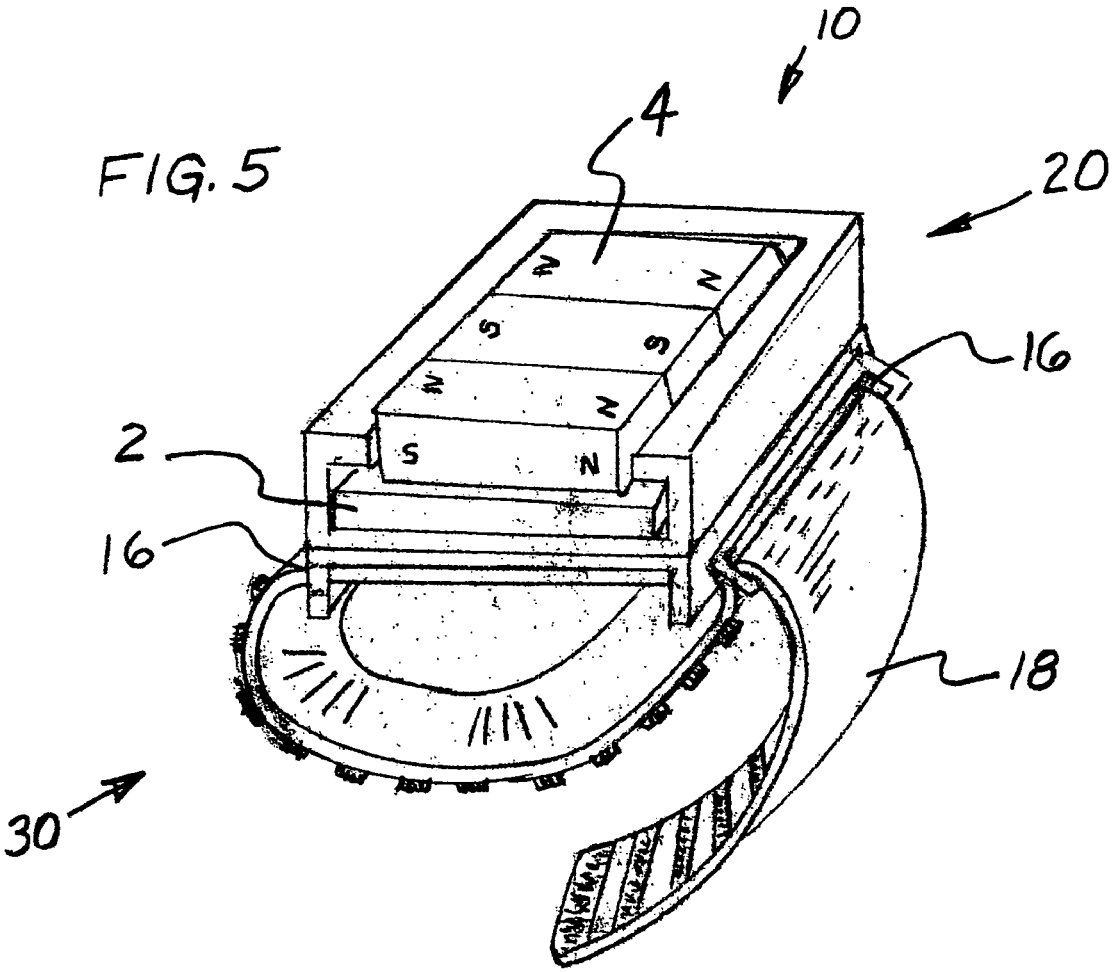
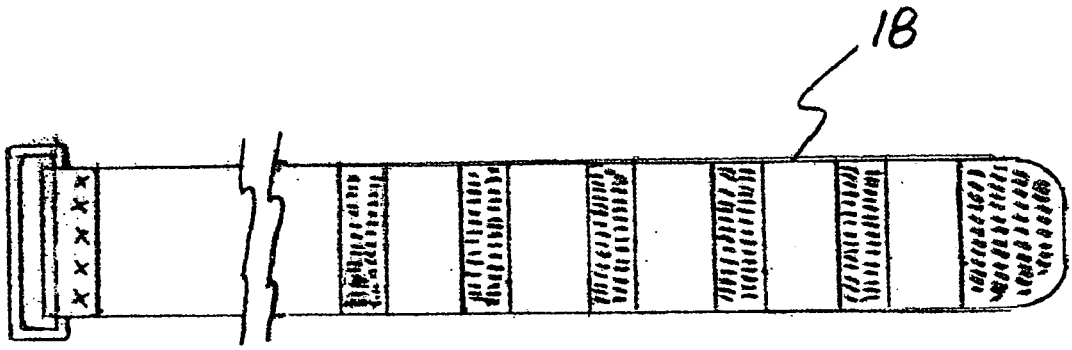
FIG. 6

MAGNETIC METAL ACCESSORY HOLDER

CROSS REFERENCE TO RELATED APPLICATIONS

This application is closely related to and claims benefit from U.S. Provisional Application Ser. No. 60/602,677 filed Aug. 17, 2004.

FIELD OF THE INVENTION

The present invention relates, in general, to a magnetic apparatus, and more particularly, the present invention relates to a magnetic apparatus designed to secure metallic items, such as nails, screws, pins, tacks, etc., and keep them handy for use.

BACKGROUND OF THE INVENTION

Everyone has had a problem with keeping things like nails, screws, paperclips, tacks, pins and the like handy to where a person is working. Often a person may hold these items in his mouth for lack of a better place to keep them, which is, obviously, not a safe thing to do. This often looks like the easiest option and many times seems like a good one, until one of the above items is swallowed and then its to late, or the person realizes what a dangerous and unsanitary item is being put into his mouth. Thus, it would be advantageous if there were an apparatus that could be used to hold such items and be able to keep such items where they would be handy for the user.

SUMMARY OF THE INVENTION

In one embodiment the present invention provides a magnetic apparatus which can be engaged to various preselected objects for holding various articles which are attracted to a magnet. The magnetic apparatus comprises a platform member having a predetermined shape and a predetermined size. At least one magnet is secured to the platform member for holding such articles. An alternate embodiment of the invention provides a magnetic apparatus which can be engaged to various preselected objects for holding various articles which are attracted to a magnet. The magnetic apparatus comprises a platform member having a predetermined shape and a predetermined size. There is at least one magnet secured to the platform member for holding such articles and a generally rectangular base member having a three sided slot formed therein for receiving and holding such platform member in a preselected position. A means is disposed on a bottom portion of the base member for securing the apparatus to such preselected objects.

OBJECTS OF THE INVENTION

It is, therefore, one of the primary objects of the present invention to provide a magnetic apparatus that can be worn or kept handy so as to hold magnetic items such as nails, screws, tacks and the like.

Another object of the present invention is to provide a magnetic apparatus which can be an adjustable wrist or arm strap.

Yet, another object of the present invention is to provide a magnetic apparatus which has a magnet platform with interchangeable bases.

Still, another object of the present invention is to provide a magnetic apparatus which can be attached to a belt clip, power cord or a pole.

Another object of the present invention is to provide a magnetic apparatus which can be used indoors or outdoors.

It is still another object of the invention to provide a magnetic apparatus which will hold magnetic items so as to free the hands to accomplish a task.

In addition to the various objects and advantages of the invention which have been described in some specific detail above it should be noted that various other objects and advantages of the present invention will become more readily apparent to those persons who are skilled in the relevant art from the following more detailed description, particularly, when such description is taken in conjunction with the attached drawing Figures and with the appended claims.

BRIEF DESCRIPTION OF THE DRAWINGS

FIG. 5 is a partial cross section view of the apparatus with the platform member disposed in the strap base member with the Velcro strap attached.

FIG. 6 is a top view of the strap member.

Figure 2:
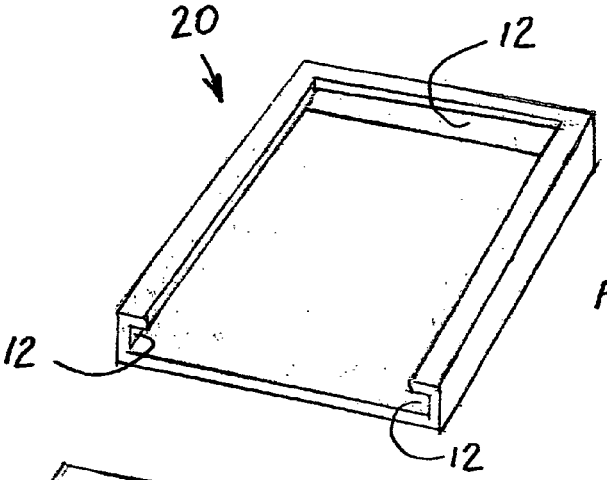
FIG. 2 is a partial perspective view of the base member for engagement with the platform member shown in FIG. 1.

BRIEF DESCRIPTION OF THE PRESENTLY PREFERRED AND VARIOUS ALTERNATIVE EMBODIMENTS OF THE INVENTION

Prior to proceeding to the more detailed description of the invention, it should be noted that identical components having identical functions have been designated with identical reference numerals throughout the several views illustrated in the drawings for the sake of clarity.

The present invention provides a magnetic apparatus, generally designated 10 which can be engaged to various preselected objects (not shown) for holding various articles (not shown) which are attracted to a magnet. The main object being to free a user's hands so as to allow them to accomplish a task while still being able to keep needed articles close by. These articles could be screws, nails, paper clips, tacks, and even hooks and fishing tackle. Thus, such apparatus 10 could be used by carpenters, teachers, fishermen or any others who may need to have small items close at hand and have the hands free to perform a task.

Figure 1:
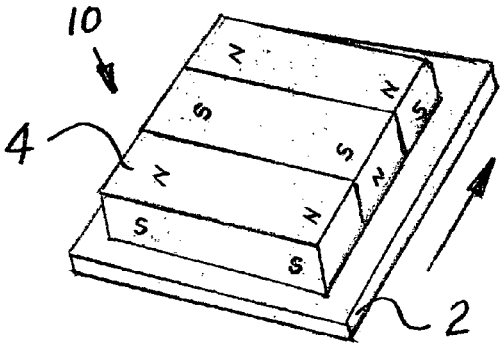
FIG. 1 is a partial perspective top view of the platform member of the apparatus according to an embodiment of the invention.
Figure 4:
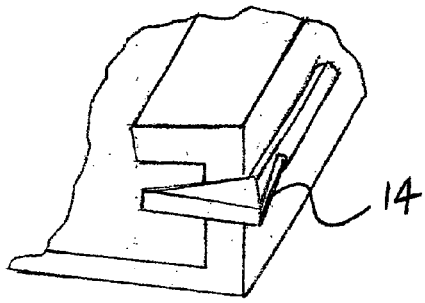
FIG. 4 is a partial cross section view of the strap base member with a latch attachment.
Figure 3:
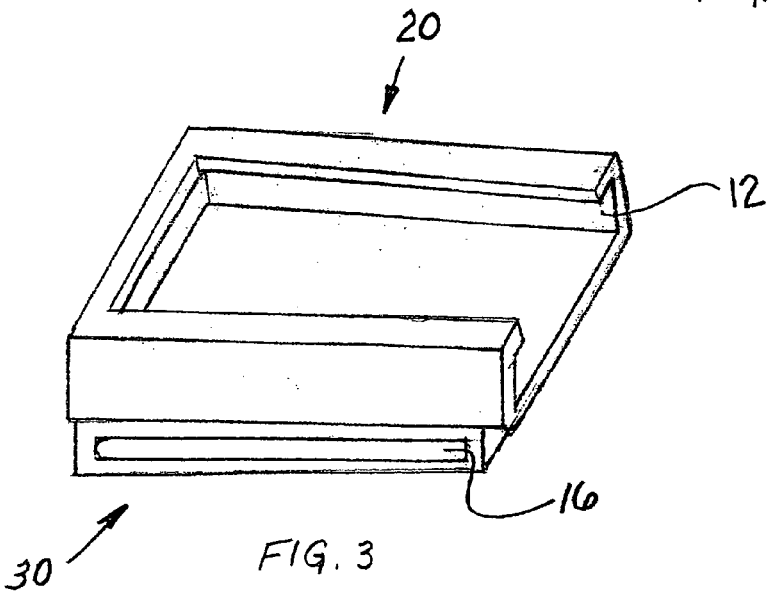
FIG. 3 is a partial perspective view of the strap base member shown in FIG. 2 showing the strap mounting slots on the strap base.
Figure 8:
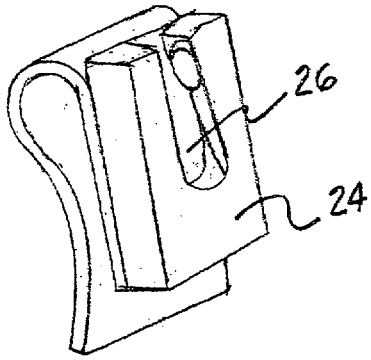
FIG. 8 is a partial perspective view of the side of a belt clip for attaching to a belt for engaging a ball mount base member.
Figure 7:
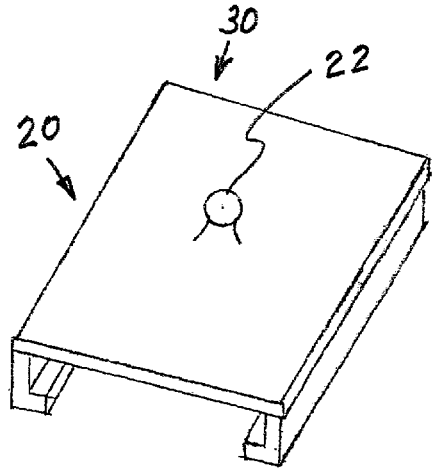
FIG. 7 is a partial perspective view of the bottom of the universal ball mount base member showing the ball mount.
Figure 9:
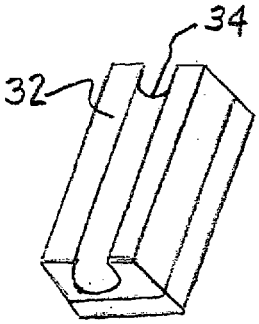
FIG. 9 is a partial perspective view of the back of a power cord mount for engaging the power cord or cable.
Figure 10:
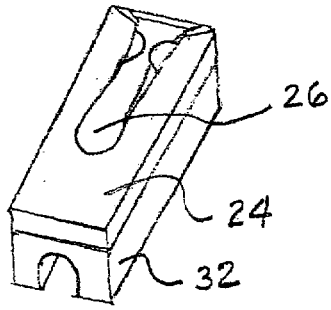
FIG. 10 is a partial perspective view of the front of a power cord mount for engaging the ball mount base member.
Figure 11:
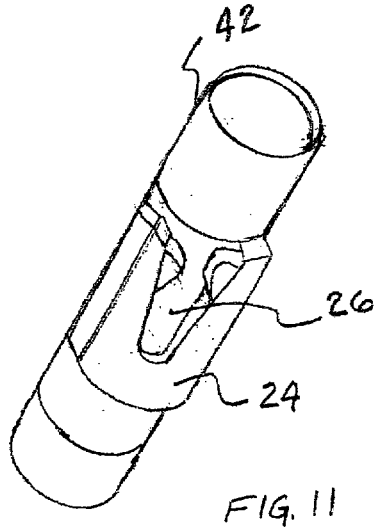
FIG. 11 is a partial perspective view of a pole mount according to yet an alternate embodiment of the invention.

The apparatus 10 comprises a platform member 2 having each of a first predetermined shape and a first predetermined size and at least one magnet 4 secured to the platform member 2 for holding such articles. Such at least one magnet having each of a second predetermined shape and a second predetermined size. Such second predetermined size as seen in FIG. 1 is smaller than the first predetermined size of the platform member 2. Such platform member 2 extends beyond the at least one magnet on all four sides of such at least one magnet. It is preferred that such magnet 4 is a ceramic magnet. It is further preferred that such at least one magnet 4 be a plurality of magnets 4 and even more presently preferred that such plurality be three magnets 4. Such magnets 4 are permanently secured to the platform member 2 and it is also preferred that such magnets 4 be positioned so as to have reversing poles. That is the magnets are mounted where the positive end of one magnet is adjacent to a magnet having a negative end next to the positive end and so on.

Such platform member 2 is made of either plastic and/or metal or both. Where the platform member 2 is metal such platform can be mounted on such preselected object without any additional securing means if the preselected object is metallic. Otherwise such apparatus 10 can be mounted to an object by means of an adhesive.

In an alternate embodiment of the invention there is provided a magnetic apparatus 10 which can be engaged to various preselected objects for holding various articles which are attracted to a magnet. The apparatus 10 comprises a platform member 2 having a predetermined shape and a predetermined size. At least one magnet 4 is secured to the platform member 2 for holding such articles and there is a generally rectangular base member, generally designated 20, having a three sided slot 12 formed therein for receiving and holding the platform member 2 in a preselected position.

As is clearly seen in FIG. 1 the platform member 2 is larger than the at least one magnet 4 (there are 3 magnets shown in FIG. 1). The platform member 2 extends beyond the magnet(s) 4 on all four sides. This permits the platform member to slide into the three sided slot 12 of the base member 20 to secure the platform member 2 without interferring with the magnet(s) 4.

The apparatus 10 also has a means, generally designated 30, that is disposed on a predetermined portion of the base member 20 for securing the apparatus 20 to such preselected objects. Such base member 20 may include a latch member 14 for locking such platform 2 in place after it is slid into such base member 20. This is useful if the base member were plastic.

In one embodiment the base member 20, wherein the predetermined portion of the base member is the bottom portion, such means 30 includes at least one aperture 16 disposed on the bottom portion of the base member 20. It is presently preferred that there are two apertures 16 disposed on the bottom portion of base member 20.

Such means 30 further includes a strap member 18 disposed through the aperture(s) 16 for securing the apparatus 10 to such preselected objects. It is preferred that such strap member 18 be made of Velcro (hook and loop) material. In this manner such apparatus can be attached to a person's wrist, arm, leg, or any other object or objects that are close to the area where the person is performing a task which the strap could encircle and thus hold the apparatus 10 in place.

Such apparatus 10 with a strap member 18 can be utilized for a wide variety of uses. It could be used in fishing where it is strapped to a person's leg to hold lures or hooks which minimizes the need to get up in a wobbly boat to find a new lure. It can be used as a wrist or arm attachment when hanging photos or putting up bulletin boards or for holding pins for a seamstress, or possibly for a teacher or office worker to hold paper clips or tacks.

In a different embodiment such means 30 includes a ball like protrusion 22 extending outwardly from the bottom portion of generally rectangular base member 20.

One use of this embodiment is where such means 30 further includes a clip 24 for engagement with a belt, pocket, brief case, or a backpack strap. The clip 24 has a pocket 26 disposed on an exterior surface for receiving and retaining the ball like protrusion 22 disposed on base member 20.

Yet another use of this embodiment such means 30 further includes a cord mount 32, such cord mount 32 is a substantially cylindrical member having a semicircular aperture 34 disposed lengthwise on one side of the cord mount 32. Such cord mount 32 is used to engage for engagement with one of a power cord or a cable. The cord mount 32 has a pocket (similar to that found on the clip member 24) disposed on a radially opposed portion from the semicircular aperture 34 of the cord mount 32 for receiving and retaining the ball like protrusion 22 disposed on the generally rectangular base member 20. Thus the cord mount 32 can be attached to the power cord of any tool or piece of equipment being used and thus be able to keep small parts such as screws, bolts, drill bits or whatever handy.

In still another embodiment of the invention such means 30 includes a pole mount 42. The pole mount 42 is a substantially hollow cylinder for engagement with a pole or a broom (not shown), the pole mount 42 has a pocket disposed on an outer surface for receiving and retaining the ball like protrusion 22 disposed on the generally rectangular base member 20. Such pole mount 42 is designed primarily as a retrieval tool so it can be attached to a pole or broom to sweep the floor for lost parts or to reach behind, into or around something.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus engageable with a preselected object for holding preselected articles attractable by a magnet, said apparatus comprising:

(a) a base member, said base member including;
  (i) a generally rectangular bottom member,
  (ii) an upstanding leg member disposed adjacent three sides of said bottom member, and
  (iii) a groove formed in each leg member on said three sides of said bottom member and facing an interior portion of an upper surface thereof;

(b) a platform member slidingly engageable with said upper surface of said bottom member and engageable in each of said grooves;

(c) at least one magnet secured to said platform member, said at least one magnet having each of a second predetermined shape and a second predetermined size and wherein said second predetermined size is smaller than said first predetermined size so that said platform member extends beyond said at least one magnet on all sides of said at least one magnet for holding various articles; and (c) a means disposed on a preselected portion of said base member for securing said apparatus to such preselected objects.

2. The magnetic apparatus, according to claim 1, wherein said preselected portion is a bottom portion of said base member and said means includes at least one aperture disposed on said bottom portion of said base member.

3. The magnetic apparatus, according to claim 2, wherein said means includes two apertures.

4. The magnetic apparatus, according to claim 2, wherein said means further includes a strap member disposed through said at least one aperture for securing said apparatus to such preselected objects.

5. The magnetic apparatus, according to claim 1, wherein said base member further includes a latch member for securing said platform member in said base member.

6. The magnetic apparatus, according to claim 1, wherein said at least one magnet is a ceramic magnet.

7. The magnetic apparatus, according to claim 1, wherein said apparatus includes a plurality of magnets.

8. The magnetic apparatus, according to claim 7, wherein said plurality of magnets is three.

9. The magnetic apparatus, according to claim 7, wherein said plurality of magnets are permanently secured to said platform member.

10. The magnetic apparatus, according to claim 7, wherein said plurality of magnets are mounted so as to have reversing poles.

11. The magnetic apparatus, according to claim 1, wherein said platform member is made of one of plastic and metal.

12. The magnetic apparatus, according to claim 1, wherein said platform member is metal.

13. The magnetic apparatus, according to claim 12, wherein said apparatus can be secured to such preselected objects when such preselected objects provide a metallic surface.

14. The magnetic apparatus, according to claim 11, wherein said platform member can be secured to such preselected objects by means of an adhesive.

15. A magnetic apparatus which can be engaged to various preselected objects for holding various articles which are attracted to a magnet, said apparatus comprising:

(a) a platform member having each of a first predetermined shape and a first predetermined size;

(b) at least one magnet secured to said platform member, said at least one magnet having each of a second predetermined shape and a second predetermined size and wherein said second predetermined size is smaller than said first predetermined size so that said platform member extends beyond said at least one magnet on all sides of said at least one magnet for holding such articles;

(c) a generally rectangular base member having a three sided slot formed therein for receiving and holding said platform member in a preselected position; and (d) a means disposed on a preselected portion of said base member for securing said apparatus to such preselected objects.

16. The magnetic apparatus, according to claim 15, wherein said preselected portion is a bottom portion and said means includes at least one aperture disposed on said bottom portion of said base member.

17. The magnetic apparatus, according to claim 16, wherein said means includes two apertures.

18. The magnetic apparatus, according to claim 16, wherein said means further includes a strap member disposed through said at least one aperture for securing said apparatus to such preselected objects.

19. The magnetic apparatus, according to claim 18, wherein said strap is comprised of hook and loop material.

20. The magnetic apparatus, according to claim 19, wherein said strap is attachable to one of a person's wrist, arm, leg, and other objects with which said strap could encircle.

21. The magnetic apparatus, according to claim 15, wherein said preselected portion is a bottom portion and said means includes a ball like protrusion extending outwardly from said bottom portion of said generally rectangular base member.

22. The magnetic apparatus, according to claim 21, wherein said means further includes a clip member for engagement with a belt, pocket, brief case, and backpack strap, said clip member having a pocket disposed on an exterior surface for receiving and retaining said ball like protrusion disposed on said bottom portion of said generally rectangular base member.

23. The magnetic apparatus, according to claim 21, wherein said predetermined portion is a bottom portion and said means said means further includes a cord mount, said cord mount being a substantially cylindrical member having a semicircular aperture disposed lengthwise on one side of said cord mount for engagement with one of a power cord and a cable, said cord mount having a pocket disposed on a radially opposed portion of said cord mount for receiving and retaining said ball like protrusion disposed on said bottom portion of said generally rectangular base member.

24. The magnetic apparatus, according to claim 21, wherein said predetermined portion is a bottom portion and said means includes a pole mount, said pole mount being a substantially hollow cylinder for engagement with one of a pole and a broom, said pole mount having a pocket disposed on said outer surface for receiving and retaining said ball like protrusion disposed on said bottom portion of said generally rectangular base member.

* * * * *